US010625927B2

(12) United States Patent
Ellsworth et al.

(10) Patent No.: US 10,625,927 B2
(45) Date of Patent: Apr. 21, 2020

(54) CONSUMER PRODUCT PACKAGE

(71) Applicant: The Procter & Gamble Company, Cincinnati, OH (US)

(72) Inventors: Justin Alan Ellsworth, Liberty Township, OH (US); Timothy David Reichling, Cincinnati, OH (US); Sheena Marie Mahrle, Liberty Township, OH (US); Karen Elizabeth Lomison, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 599 days.

(21) Appl. No.: 15/273,868

(22) Filed: Sep. 23, 2016

(65) Prior Publication Data

US 2018/0086541 A1 Mar. 29, 2018

(51) Int. Cl.

| | |
|---|---|
| ***B65D 83/00*** | (2006.01) |
| ***A45D 34/04*** | (2006.01) |
| ***A45D 40/04*** | (2006.01) |

(52) U.S. Cl.

CPC ..... *B65D 83/0011* (2013.01); *A45D 34/04* (2013.01); *A45D 40/04* (2013.01); *A45D 2200/055* (2013.01)

(58) Field of Classification Search

CPC ..... B65D 83/0011; B65D 83/0005; B65D 83/0016; A45D 40/04

See application file for complete search history.

(56) References Cited

U.S. PATENT DOCUMENTS

| | | | |
|---|---|---|---|
| 4,702,399 | A | 10/1987 | Davis |
| 5,000,356 | A | 3/1991 | Johnson et al. |
| 5,007,755 | A | 4/1991 | Thompson |
| 5,547,302 | A | 8/1996 | Dornbusch et al. |
| 5,697,531 | A | 12/1997 | Fattori |
| 5,725,133 | A | 3/1998 | Iaia |
| 5,839,622 | A | 11/1998 | Bicknell et al. |
| 5,879,096 | A | 3/1999 | Franta et al. |

(Continued)

FOREIGN PATENT DOCUMENTS

| | | |
|---|---|---|
| DE | 3139192 | 4/1983 |
| DE | 20 2014 103 450 U1 | 11/2014 |

(Continued)

OTHER PUBLICATIONS

PCT International Search Report, dated Nov. 10, 2017 (14 pages).

(Continued)

*Primary Examiner* — J C Jacyna

(74) *Attorney, Agent, or Firm* — Kathleen Y. Carter

(57) ABSTRACT

A dispensing package, the dispensing package includes a longitudinal axis; a shell including a chamber disposed within the shell, a first end, a second end opposite the first end, a first plurality of shell protrusions extending upwardly away from the first end, and a second plurality of shell protrusions extending downwardly in a direction opposite the first plurality of shell protrusions; a screw assembly including a screw base disposed adjacent to the first end and rotatably associated with the shell, a spindle extending from the screw base through the bottom wall into the chamber coaxial to the longitudinal axis of the package; and an elevator platform movably engaged to the spindle of the screw assembly.

31 Claims, 15 Drawing Sheets

(56) References Cited

U.S. PATENT DOCUMENTS

| | | | | |
|---|---|---|---|---|
| 5,947,621 | A | 9/1999 | Szekely | |
| 5,961,007 | A | 10/1999 | Dornbusch et al. | |
| 6,039,483 | A | 3/2000 | Szekely | |
| 6,143,284 | A | 11/2000 | Bush et al. | |
| 7,086,564 | B1 | 8/2006 | Corrigan | |
| 7,303,348 | B2 * | 12/2007 | Phipps | A61M 35/003 222/390 |
| 7,374,360 | B1 | 5/2008 | *Szekely | |
| 7,389,894 | B2 | 6/2008 | Danne et al. | |
| 9,265,327 | B2 | 2/2016 | Thulin et al. | |
| 2008/0050168 | A1 * | 2/2008 | Groh | B65D 83/0011 401/68 |
| 2009/0324321 | A1 * | 12/2009 | Nasu | A45D 40/04 401/172 |
| 2010/0196079 | A1 | 8/2010 | *Bolander et al. | |
| 2010/0217176 | A1 | 8/2010 | Carrara et al. | |
| 2012/0039655 | A1 * | 2/2012 | Baines | A45D 40/04 401/68 |
| 2013/0039687 | A1 | 2/2013 | *Bolander et al. | |
| 2015/0003885 | A1 | 1/2015 | Wade et al. | |
| 2015/0201735 | A1 | 7/2015 | Swaile et al. | |
| 2016/0174687 | A1 | 6/2016 | Ellsworth | |

FOREIGN PATENT DOCUMENTS

| | | | |
|---|---|---|---|
| EP | 0312165 | | 4/1989 |
| EP | 0 387 213 | B1 | 5/1995 |
| JP | 2011050521 | | 3/2011 |
| JP | 5374342 | | 12/2013 |
| JP | 105249659 | | 1/2016 |
| KR | 20-0416565 | Y1 | 5/2006 |
| KR | 2011-0004036 | U | 4/2011 |
| KR | 2011-0009049 | U | 9/2011 |
| WO | 2009/064762 | A2 | 5/2009 |
| WO | WO 2010/088652 | | 8/2010 |
| WO | 2016/062583 | A1 | 4/2016 |
| WO | 2016/062584 | A1 | 4/2016 |

OTHER PUBLICATIONS

PCT International Search Report, dated Nov. 10, 2017 (12 pages).
All Office Actions, U.S. Appl. No. 14/971,943.
U.S. Appl. No. 15/273,918, filed Nov. 23, 2016: all office actions.

* cited by examiner

CONSUMER PRODUCT PACKAGE

BACKGROUND

The consumer products industry is continually releasing a variety of new and improved consumer products. As such, the consumer products industry is continually providing to the consumers a wide variety of product packages to dispense and deliver this ever-growing variety of products. However, each new package platform creates added design, manufacturing, inventory, and ancillary costs. As such, there is a need for improved consumer product packages that can serve as dispensing and delivery packages for multiple products.

SUMMARY

In one aspect, a dispensing package includes a longitudinal axis; a shell including a chamber disposed within the shell, a first end, a second end opposite the first end, a first plurality of shell protrusions extending upwardly away from the first end, and a second plurality of shell protrusions extending downwardly in a direction opposite the first plurality of shell protrusions; a screw assembly including a screw base disposed adjacent to the first end and rotatably associated with the shell, a spindle extending coaxially to the longitudinal axis from the screw base through the bottom wall into the chamber; and an elevator platform movably engaged to the spindle of the screw assembly.

In another aspect, a screw assembly for a consumer product dispensing package includes a longitudinal axis; a screw base including a plurality of screw base protrusions extending upwardly from the screw base; a spindle extending from the screw base coaxial to the longitudinal axis, the spindle including an outer surface and threads disposed about the outer surface; and a platform extending radially from the spindle and spaced apart from the screw base, wherein the platform includes a plurality of spindle protrusions extending downwardly from the platform.

In yet another aspect, a dispensing package includes a longitudinal axis; a shell including a chamber disposed therein and constructed to contain a consumer product, a first end, and a second end opposite the first end; and a screw assembly including a screw base disposed adjacent to the first end and rotatably associated with the shell, the screw base including a plurality of screw base protrusions extending upwardly from the screw base, a spindle extending coaxially to the longitudinal axis from the screw base through the bottom wall into the chamber, the spindle including an outer surface and threads disposed about the outer surface; and a platform extending radially from the spindle and spaced apart from the screw base, the platform including a plurality of spindle protrusions extending downwardly from the platform.

DETAILED DESCRIPTION

Figure 1:
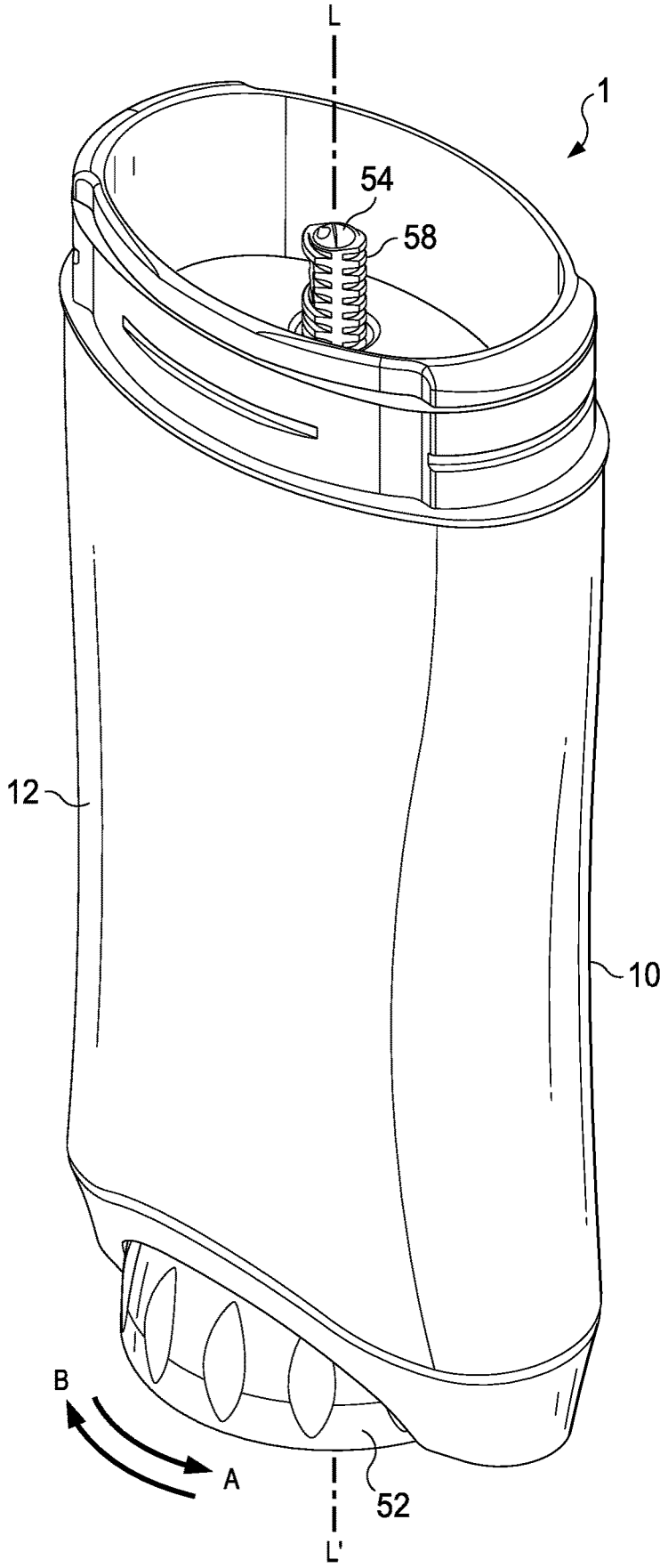
FIG. 1 is a front isometric of a dispensing package according to one or more aspects.
Figure 2:
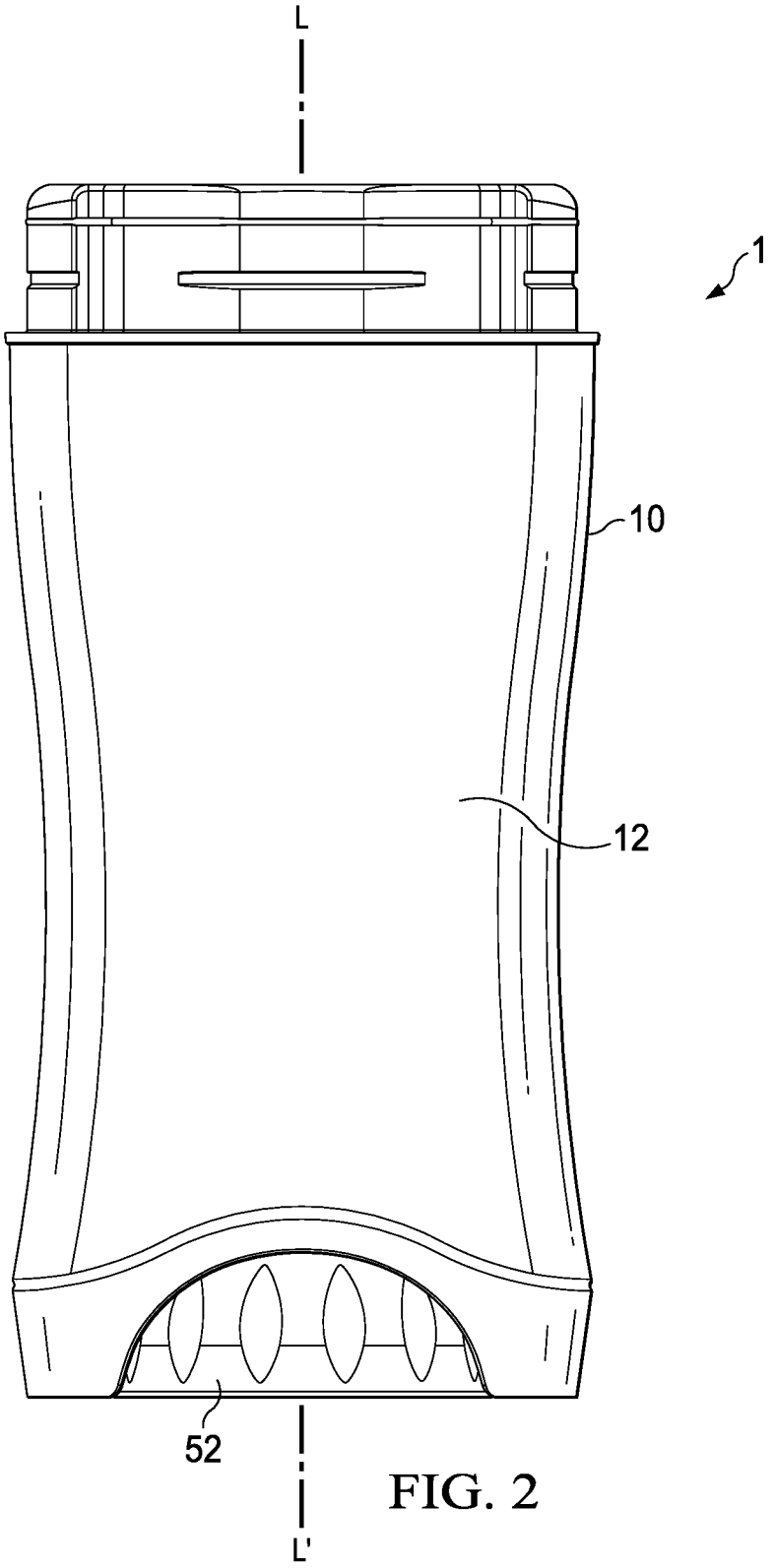
FIG. 2 is a front elevational view of the dispensing package of FIG. 1.
Figure 3:
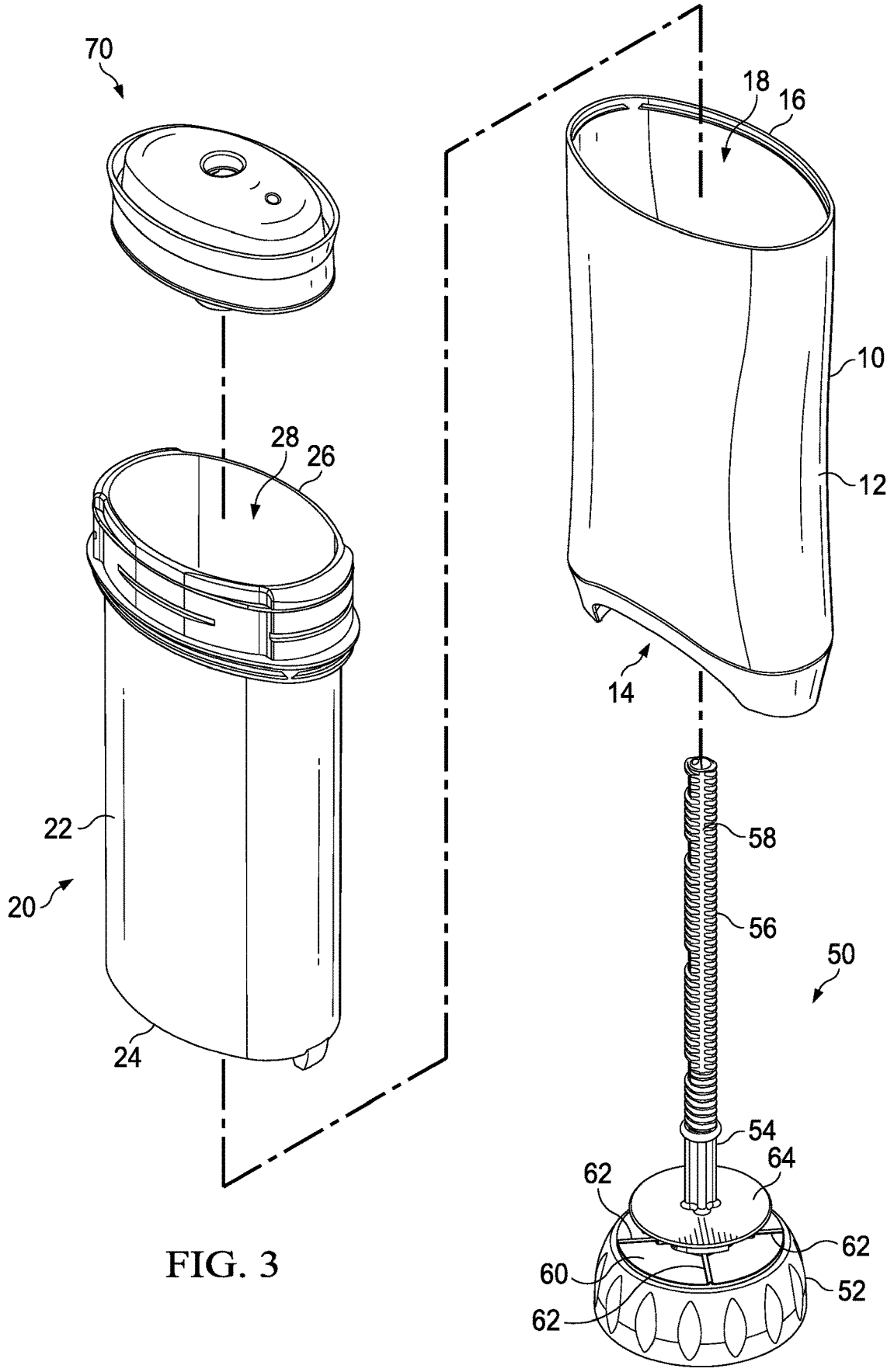
FIG. 3 is an exploded top isometric view of the dispensing package of FIG. 1.
Figure 4:
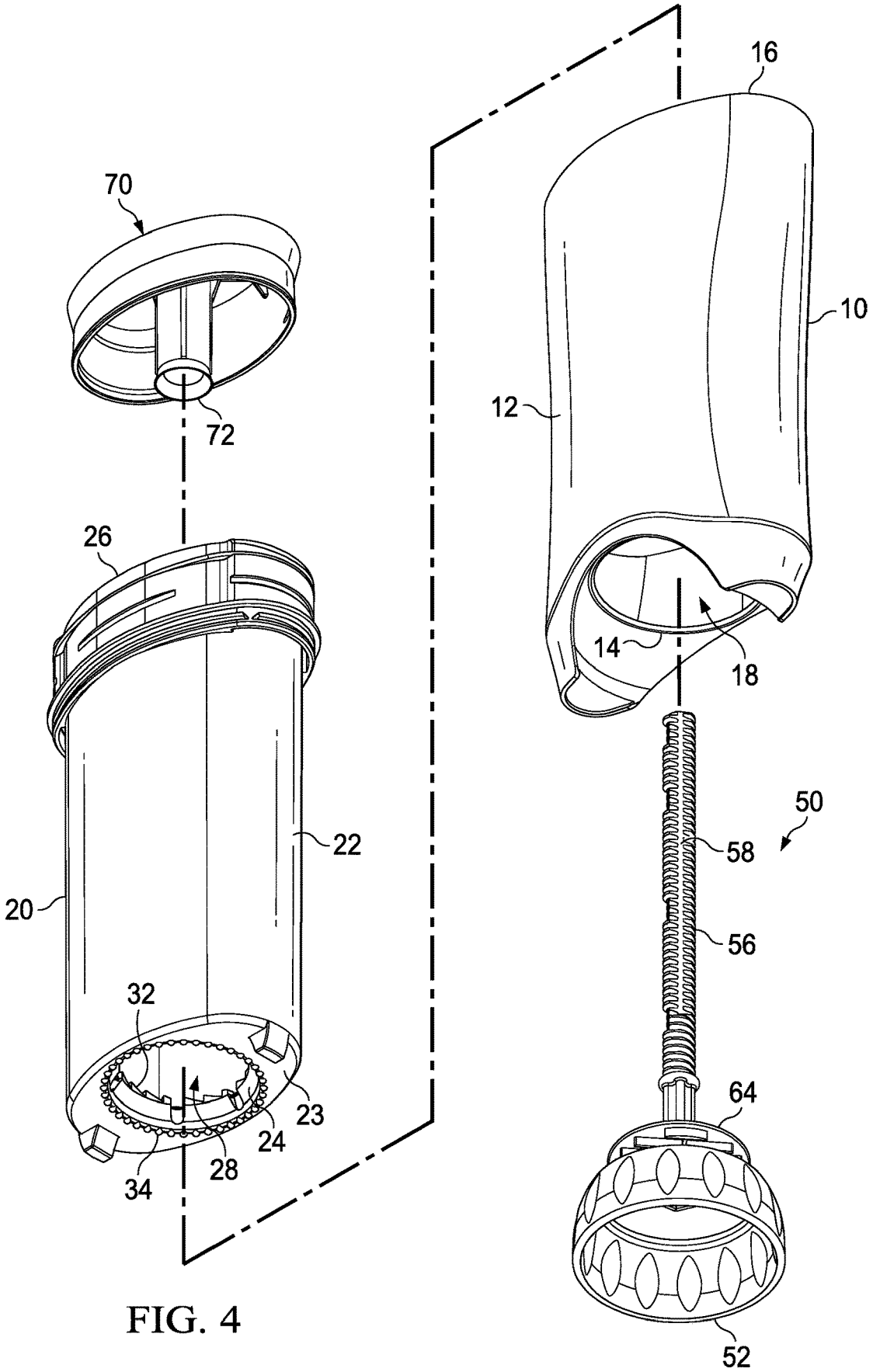
FIG. 4 is an exploded bottom isometric view of the dispensing package of FIG. 1.
Figure 5:
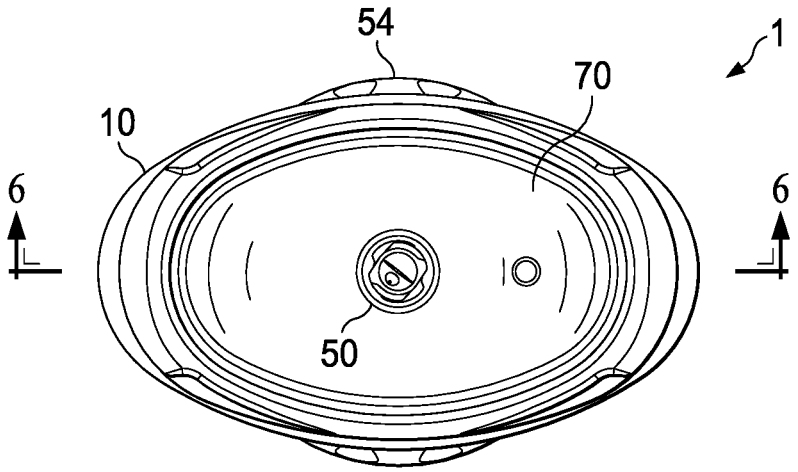
FIG. 5 is a top planar view of the dispensing package of FIG. 1.
Figure 7:
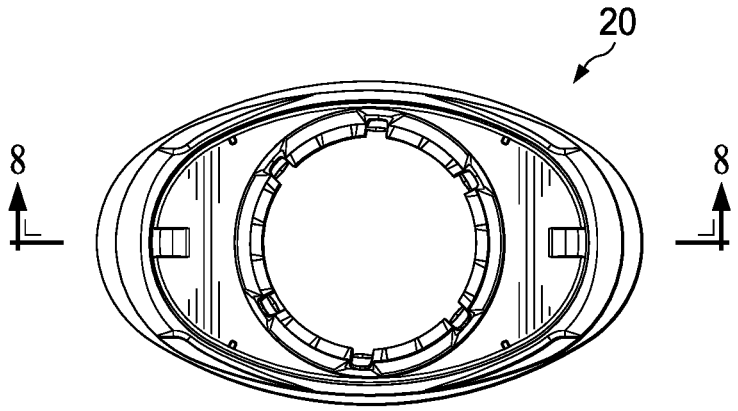
FIG. 7 is bottom planar view of the dispensing package of FIG. 5.

The following text sets forth a broad description of numerous different aspects. The description is to be construed as exemplary only and does not describe every possible aspect since describing every possible aspect would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative aspects could be implemented, using either current technology or technology developed after the filing date of this patent, which would still fall within the scope of the claims.

No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

In one or more aspects described and shown herein, the personal care product or composition may be an antiperspirant and deodorant composition which can be formulated as any known or otherwise effective product suitable for delivering an antiperspirant and deodorant active to the desired area of the skin. Nonlimiting examples of such product forms include liquids such as roll-ons; solids such as gel solids, solid sticks, and suspensoids; semi-solids/liquids such as soft solids, creams and lotions.

The one or more aspects of the dispensing package described and shown herein may dispense these personal care compositions which are intended for topical application to the underarm or other suitable areas of the skin. The personal care composition may be deodorant and antiperspirant compositions. The personal care composition may comprise an active ingredient and a suspending or thickening agent incorporated into a suitable liquid carrier. In this context, the term "active" may be an antiperspirant actives, deodorant actives, or fragrances, and include any known or otherwise safe and effective antiperspirant, deodorant, or fragrance active material. The terms "antiperspirant active" and "deodorant active" may be topical materials which can prevent, decrease, or eliminate malodors and/or perspiration wetness.

The term "fragrance" as used herein specifically refers to any topical material which covers or masks malodors resulting from perspiration, or which otherwise provides the composition with the desired perfumed aroma.

In some aspects, the personal care product includes a composition that does not weep under pressure, including but not limited to, compositions that do not include silicone, functional equivalents, or the like.

Referring to FIGS. 1 to 9, an illustrative dispensing package is shown as 1. The dispensing package 1 includes a longitudinal axis L-L'. In some aspects the dispensing package 1 may include an outer shell 10. The outer shell 10 may comprise any variety of shapes, sizes, designs, and/or configurations. In some aspects, such as the one shown in the figures, the outer shell 10 may include a side wall 12, a first open end 14, and a second open end 16, opposite the first open end. The side wall 12 may form a chamber 18, connecting the first and second open ends 14 and 16, respectively. In some aspects, the chamber 18 may be constructed to receive a second shell that is at least partially inserted therein (e.g., inner shell 20 shown and described below).

Figure 8:
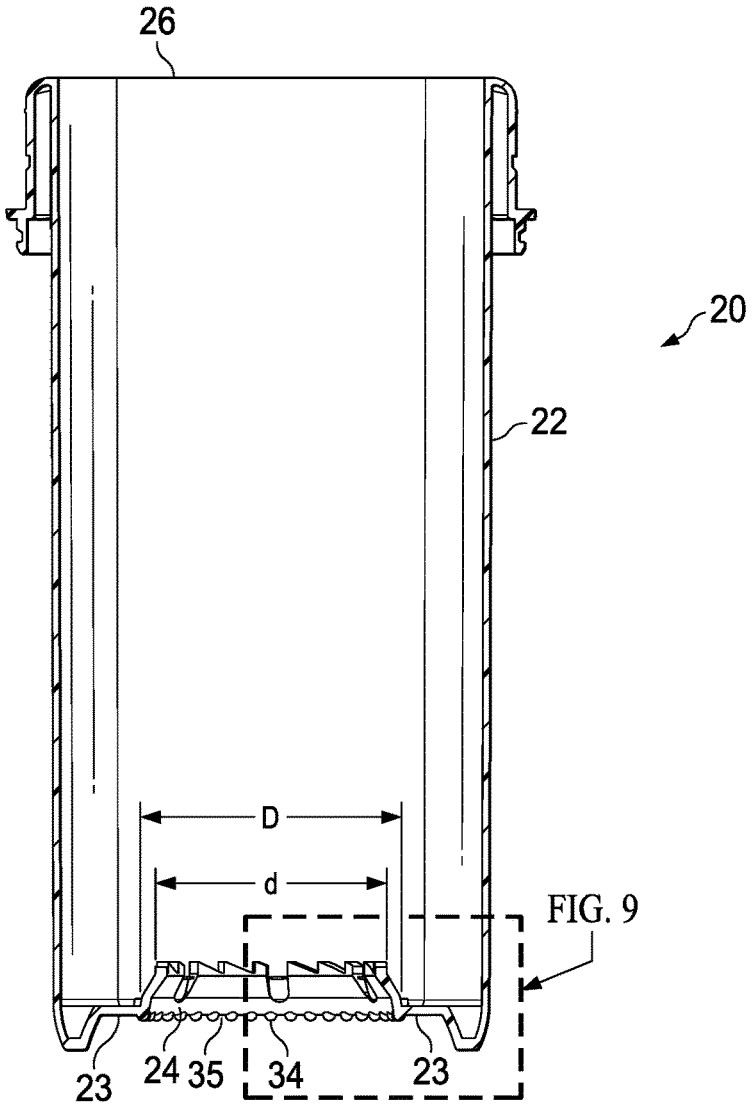
FIG. 8 is a cross sectional view of an inner shell of the dispensing package of FIG. 7.

The dispensing package 1 may further include an inner shell 20 that may insert into the chamber 18 of the outer shell. In some aspects the outer shell 10 and inner shell 20 are coaxially-aligned with each other along the longitudinal axis L-L'. In some aspects such as the one shown in the figures, the inner shell 20 may include a side wall 22, a bottom wall 23, a first open end or opening 24 disposed through the bottom wall, and a second open end or opening 26, opposite the first open end. The side wall 22 and bottom wall 23 of the inner shell may form a chamber 28, connecting the first and second open ends 24 and 26, respectively. In some aspects, such as the example shown in FIGS. 1-9, the first end opening 24 may comprise an angled opening such that first end opening 24 may have a first diameter (D) and then angle radially inwardly to a second diameter (d) spaced apart from the first diameter as best shown in FIG. 8. In this aspect, the chamber 28 of the inner shell 20 may be constructed to contain and/or hold a consumer product such as those described herein until the consumer product is dispensed therefrom.

In the aspect shown, the first open end 24 of the inner shell 20 may include a first plurality of shell protrusions 32 that extend upwardly away from the first open end 24 and/or the bottom wall 23. Also, the inner shell 20 may include a second plurality of shell protrusions 34 that may extend downwardly away from the first open end 24 and/or the bottom wall 23. The second plurality of shell protrusions 34 may extend in a direction opposite the first plurality of shell protrusions 32. In some aspects, each one of the first plurality of shell protrusions 32 are disposed sequentially adjacent to the next one of the first plurality of shell protrusions 32 about the first open end 24. Similarly, each one of the second plurality of shell protrusions 34 are disposed sequentially adjacent to the next one of the second plurality of shell protrusions 34 about the first open end 24. In some aspects, the first open end 24 is circular in shape and thus the first and second pluralities of protrusions 32, 34, respectively, are disposed about the first open end 24 in a circular shape. In the aspect shown, the bottom wall 23 and first open end 24 are integral to the side wall 22. In some aspects, the first plurality of shell protrusions 32 comprise from about 1 to about 60 protrusions, from about 10 to about 50 protrusions, or from about 10 to about 40 protrusions. In some aspects, the second plurality of shell protrusions 34 comprise from about 1 to about 60 protrusions, from about 10 to about 50 protrusions, or from about 15 to about 40 protrusions.

In some aspects, each pair of adjacent protrusions of the first plurality of shell protrusions 32 does not include a gap between them. In other aspects, each pair of adjacent protrusions of the first plurality of shell protrusions 32 may include a gap between each pair. Similarly, in some aspects, each pair of adjacent protrusions of the second plurality of shell protrusions 34 does not include a gap between them. However, in the aspects shown in FIGS. 1-16, each pair of adjacent shell protrusions 32 of the first plurality of shell protrusions may include a gap 33 (e.g., first gap 33*a*, second gap 33*b*, any subsequent gap 33*n*, shown in FIG. 9) between them. Also, in the aspects shown in FIGS. 1-16, each pair of adjacent shell protrusions 34 of the second plurality of shell protrusions may include a gap 35 (e.g., first gap 35*a*, second gap 35*b*, any subsequent gap 35*n*, shown in FIG. 9) between them.

Referring to FIGS. 10-13, another aspect of package 1 is shown. The package 1, in this aspect, may include some or substantially all of the same components and features as the aspect described above and shown in FIGS. 1-9. In this aspect, the inner shell 20 does not include a bottom wall integrally connected to the side wall 22. As such, the side wall 22 forms the first end opening 24. Instead, the inner shell 20 includes a attachable bottom wall or plug 25 that may be inserted into the first open end 24 and connected and/or sealed to the side wall 22 at the first open end 24 as conventionally known. The plug 25 may include an opening 27 centrally positioned and disposed therethrough. As shown, the opening may be an angled opening such that at one end the opening may have a first diameter (D) and then angle inwardly to a second diameter (d). The plug 25 may include a first plurality of shell protrusions 32 that extend upwardly away from the bottom wall (or a portion of bottom wall such as, for example, plug wall 29) and are disposed about the opening 27. The bottom wall or plug 25 may also include the second plurality of shell protrusions 34 that extend downwardly away from the bottom wall (or a portion of bottom wall such as, for example, plug wall 29) and are disposed about the opening 27. In other words, the bottom wall, its opening, and the first and second pluralities of protrusions are not integrally formed with the side wall 22 (i.e., a plug-style package) as shown and described above with regard the first aspect.

Figure 13:
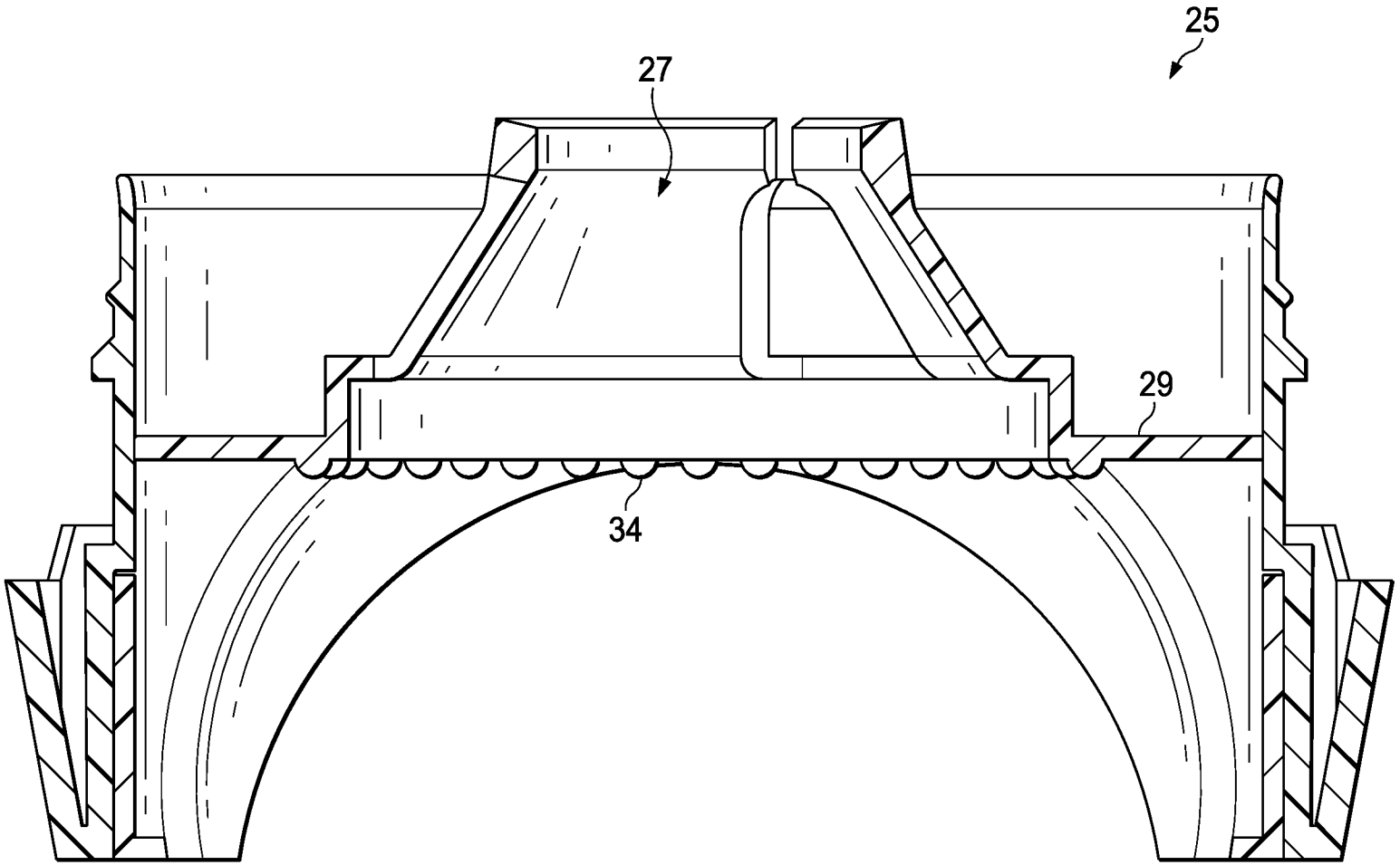
FIG. 13 is another plug of the dispensing package of FIG. 10.

In other aspects such as, for example, the one shown in FIG. 13, the plug 25 may not include the first plurality of shell protrusions and thus only include the second plurality of shell protrusions 34. Alternatively, the plug 25 may include only the first plurality of shell protrusions 32 and not include the second plurality of shell protrusions 34 (this aspect is not shown).

Figure 14:
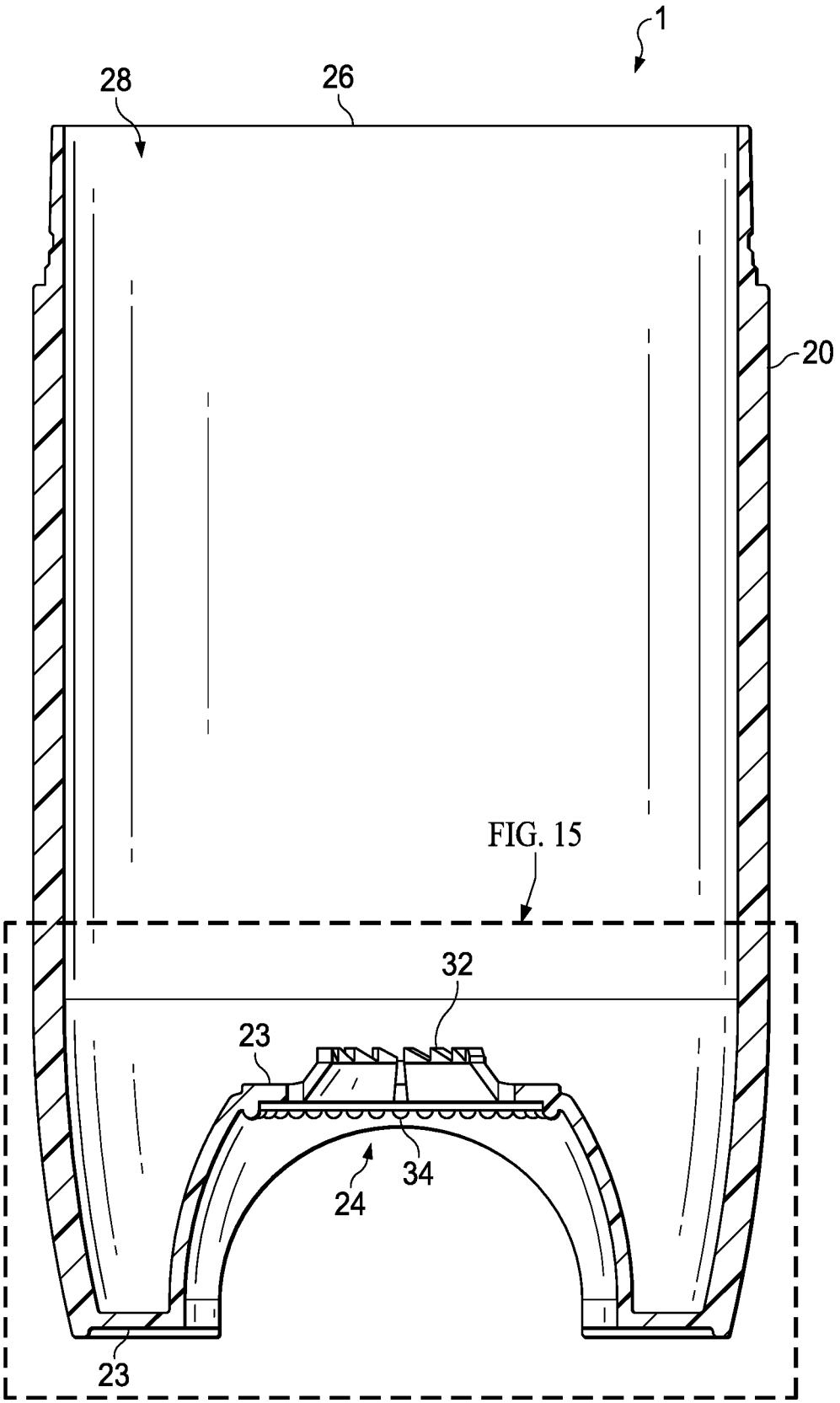
FIG. 14 is a cross sectional view of another dispensing package according to one or more aspects.
Figure 15:
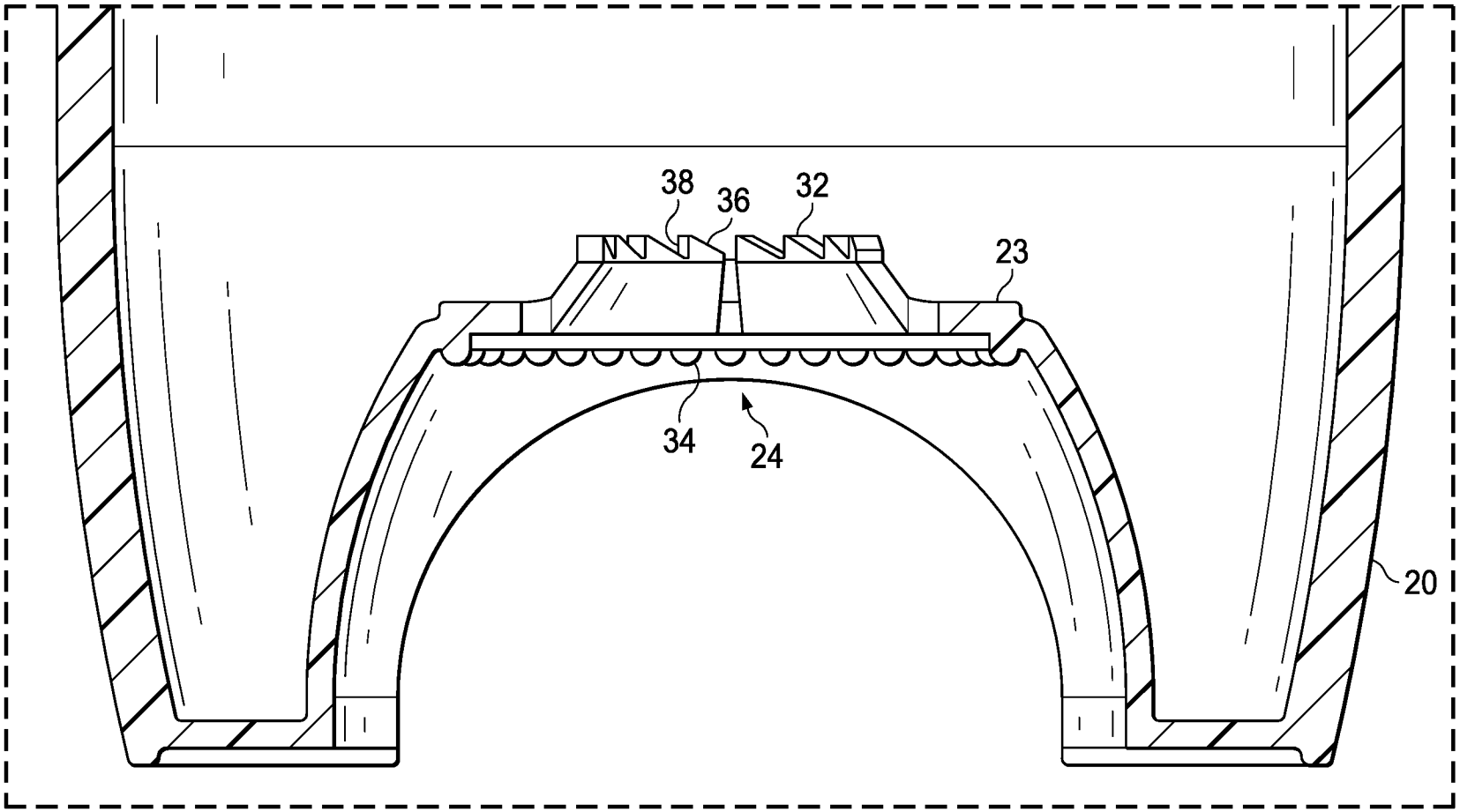
FIG. 15 is a detail, cross sectional view of a plug of the dispensing package of FIG. 14.

Referring to FIGS. 14-15, another aspect of package 1 is shown. In this aspect, the package 1 does not include a separate outer shell 10. Rather, shell 20 acts as both the inner and outer shells. Shell 20 may include some of or all of the features and components of the one or more aspects shown and described above herein. As shown in FIGS. 14-15, the aspect includes the first plurality of shell protrusions 32 and the second plurality of shell protrusions 34.

Figure 16:
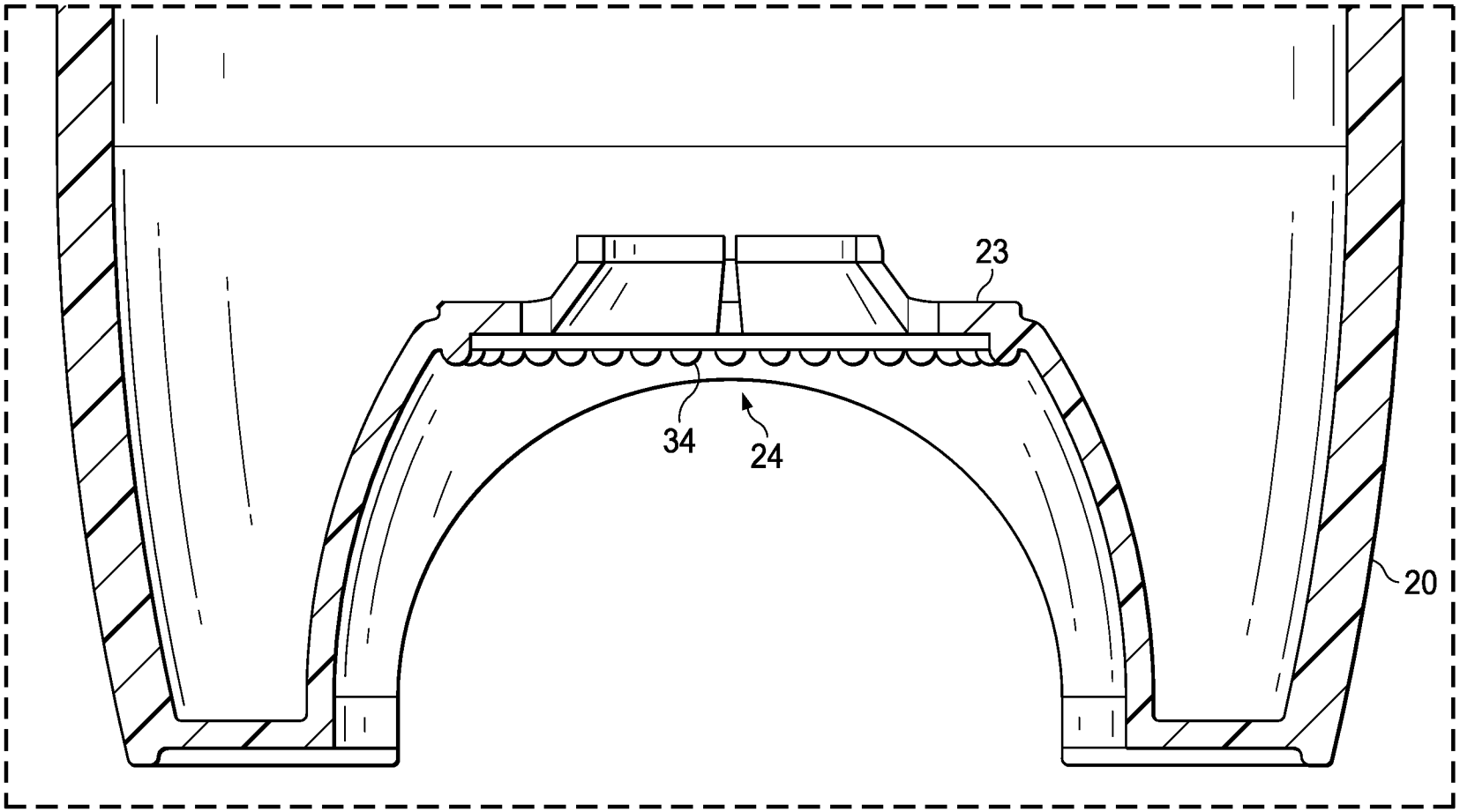
FIG. 16 is another plug of the dispensing package of FIG. 10.

Referring to FIG. 16, another aspect of package 1 is shown. In this aspect, the package 1 also does not include a separate outer shell 10. Rather, shell 20 acts as both the inner and outer shells. Shell 20 may include some of or all of the features and components of the one or more aspects shown and described above herein. As shown in FIG. 16, the aspect does not include the first plurality of shell protrusions 32 and thus only includes the second plurality of shell protrusions 34. Alternatively, the package 1 may include only the first plurality of shell protrusions 32 and not include the second plurality of shell protrusions 34 (this aspect is not shown).

Figure 9:
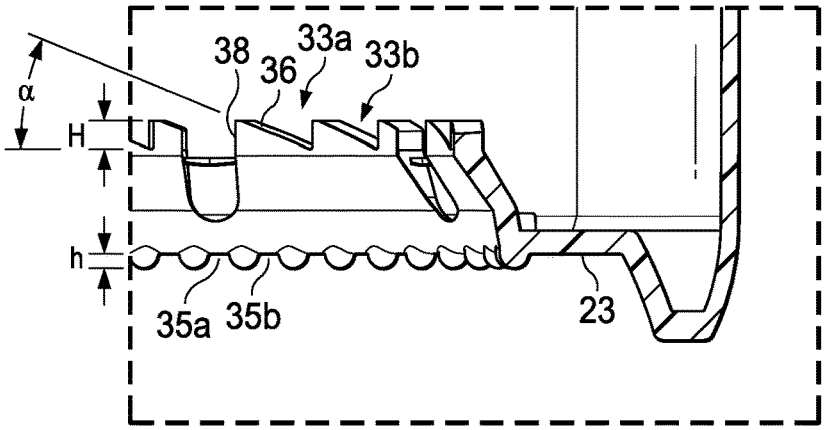
FIG. 9 is a detail view of the inner shell of FIG. 8.
Figure 10:
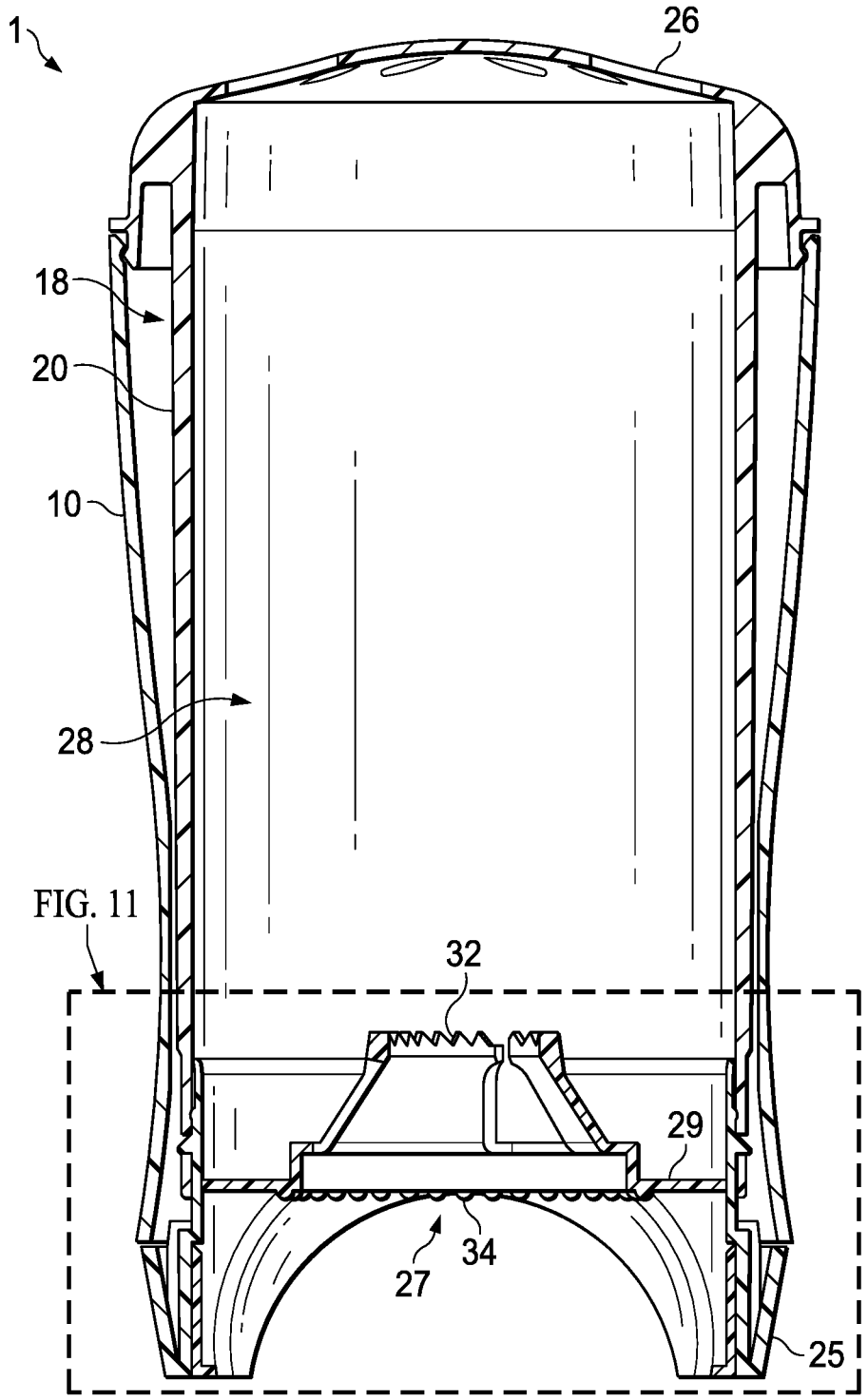
FIG. 10 is a cross sectional view of another dispensing package according to one or more aspects.
Figure 11:
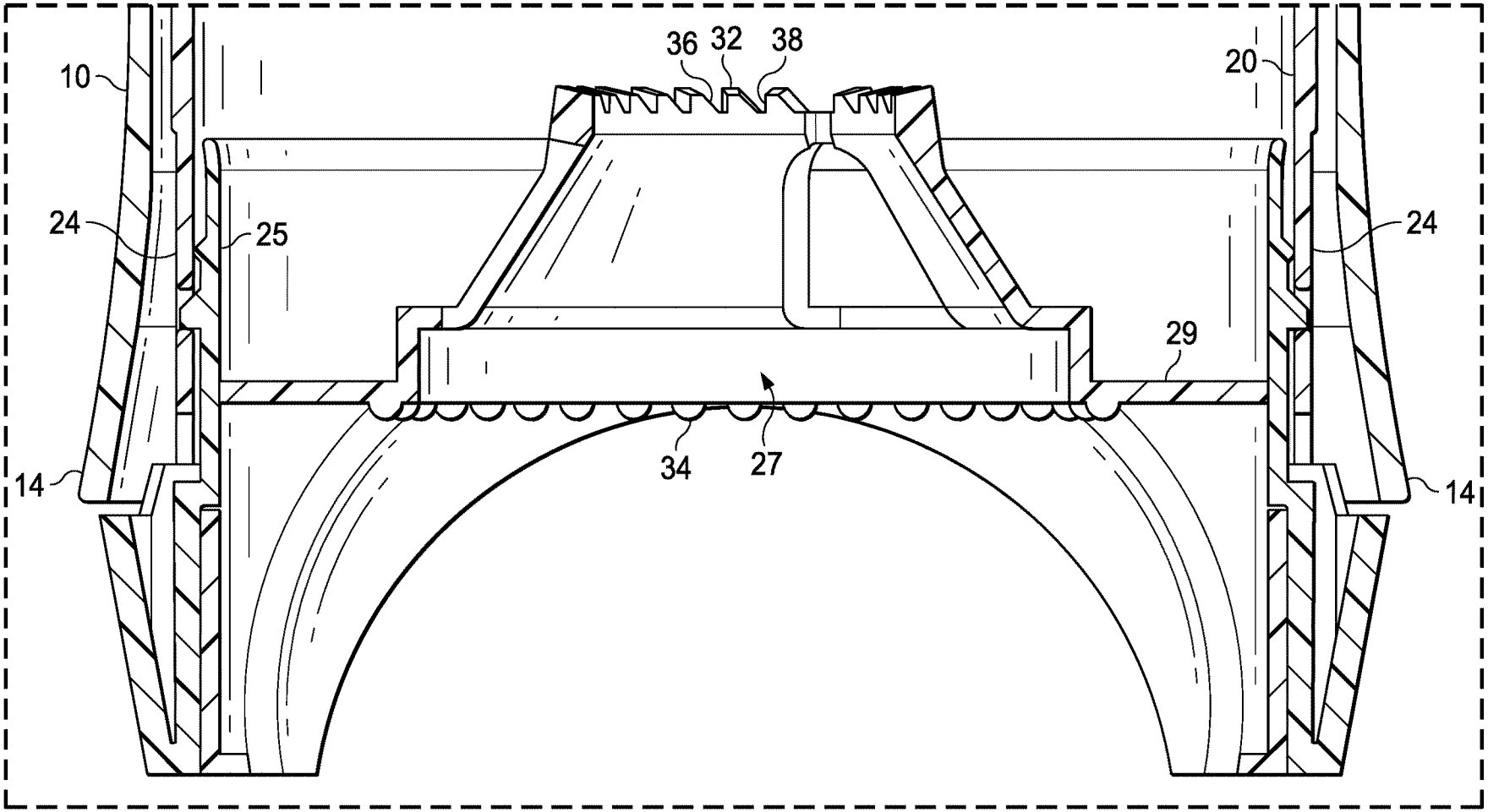
FIG. 11 is a detail, cross sectional view of a plug of the dispensing package of FIG. 10.
Figure 12:
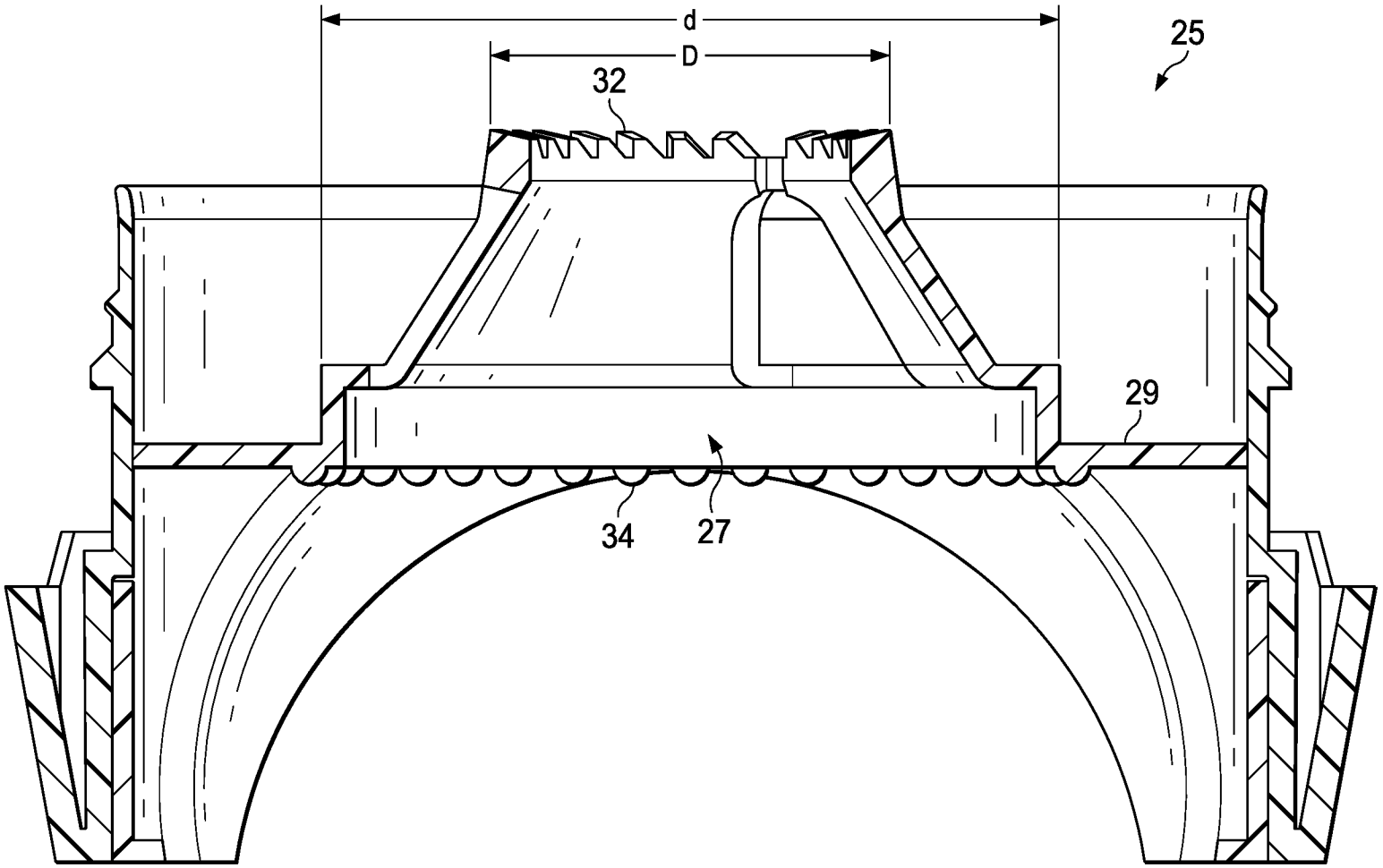
FIG. 12 is a plug of the dispensing package of FIG. 10.

The protrusions of the first and second pluralities of protrusions 32 and 34 described and shown above are only examples of one or more configurations. It is understood that the first and second pluralities of protrusions 32 and 34 in the one or more aspects set forth above herein may include any variety of types of protrusions having any variety of shapes, sizes, designs, and configurations, including but not limited to nubs, pawls, tabs, ramps, cams, teeth, ratchet teeth, the like, and/or combinations thereof. In the aspects shown in FIGS. 1-16, the first plurality of shell protrusions 32 are shell teeth having a cam surface 36 and a side wall 38. With reference to FIG. 9, the shell teeth may have a height (H) from about 0.0.010 in. to about 0.10 in. The cam surface 36 may also have a cam angle α from about 10 degrees to about 75 degrees, form about 15 degrees to about 50 degrees, from about 30 degrees to about 50 degrees, or from about 40 degrees to about 45 degrees. In some aspects, cam angle α is about 20 degrees. In the aspects shown, the first plurality of shell protrusions 32 are, optionally constructed to provide pressure relief on the product contained within the chamber 28, reducing and/or preventing weeping of the product from the dispensing end, i.e., the second open end 26. In some aspects, this weeping prevention is accomplished via the shape, size, spacing, etc., of the protrusions as known in the art. In some aspects, the first plurality of shell protrusions 32 may be constructed to provide dosing indicia to the consumer through audio queues and/or tactile queues. In some aspects, the first plurality of shell protrusions 32 may be constructed to provide macro-dosing indicia to the consumer through audio queues and/or tactile queues, wherein a macro-dose comprises a dose of product of greater than about 0.15 grams (e.g., per click), or greater than 0.19 grams (e.g., per click), or greater than 0.2 gram (e.g., per click), or from about 0.15 grams (e.g., per click) to about 4 grams (e.g., per click), or from about 0.15 grams (e.g., per click) to about 0.60 grams (e.g., per click), or from about 0.19 grams (e.g., per click) to about 0.60 grams (e.g., per click). It is understood that such doses may also be provided by requiring multiple clicks to achieve such dosage.

In the aspect shown in FIGS. 1-16, the second plurality of shell protrusions 34 are pawls or nubs having a height (h) from about 0.005 in. to about 0.060 in., or from about 0.010 in. to about 0.050 in., or from about 0.025 in. to about 0.040 in. In this aspect, the second plurality of shell protrusions 34 are constructed in order to not provide pressure relief to and/or reduce and/or eliminate weeping of the product contained within the chamber 28. In this aspect, the protrusions are positioned about the first open end 24 such that there is the gap 35 between each adjacent pair of protrusions 34 (e.g., first gap 35*a*, second gap 35*b*, etc.). The protrusions 34 are constructed to provide micro-dosing indicia to the consumer through audio queues such as, an audio signal (e.g., a "clicking" sound) and/or tactile queues such as resistance to the rotation of the screw base. In some aspects, a micro-dose may comprise a dose of product from about 0.05 grams to about 2.0 grams (e.g., per click), or from about 0.05 grams to about 0.19 grams (e.g., per click), or from 0.05 grams (e.g., per click) to about 0.15 grams (e.g., per click), or less than about 0.2 grams (e.g., per click). It is understood that such doses may also be provided by requiring multiple clicks to achieve such dosage.

It should be understood that, in some aspects, the first plurality of shell protrusions 32 and the second plurality of shell protrusions 34 may also be disposed at the first open end 14 of the outer shell 10 rather than the first open end 24 of the inner shell 20.

It should also be understood that in some aspects, the first plurality of shell protrusions 32 may comprise non-pressure relieving protrusions such as, for example, pawls (e.g., shell pawls 34 shown in FIG. 9), and the second plurality of shell protrusions 34 may comprise pressure relieving protrusions such as, for example, ratchet teeth (e.g., shell teeth 32 shown in FIG. 9). Essentially, the type of protrusions can be swapped. In addition, in some aspects, the first plurality of shell protrusions 32 and second plurality of shell protrusions 34 may be constructed to have the same or similar size, shape, design, and/or configuration as each other.

Still referring to FIGS. 1-16, in one or more of the aspects described and shown above herein, the dispensing package 1 may include a screw assembly 50. The screw assembly 50 may be partially or fully inserted into the first open end 24 of the inner shell 20. The screw assembly 50 may include a screw base 52, a spindle 54 extending from the screw base 52 and having an outer surface 56, and threads 58 disposed along the outer surface 56 about at least a portion of the spindle 54.

Figure 6:
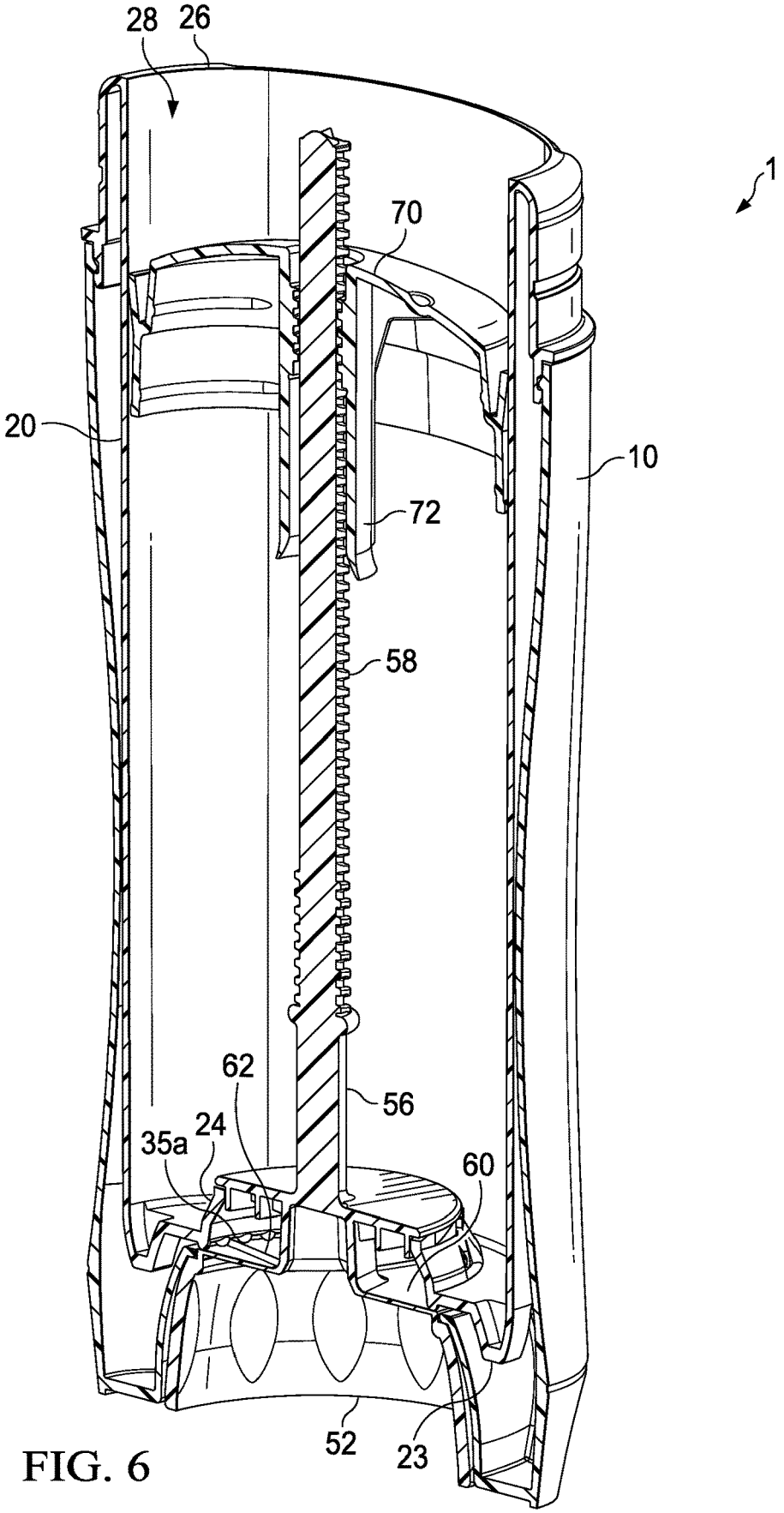
FIG. 6 is a cross sectional view of an inner shell of the dispensing package of FIG. 1.

The screw base 52 may include one or more protrusions extending upwardly from the screw base. In the aspect shown in the figures, the screw base 52 may include a top surface 60 and protrusions 62, for example, four protrusions, extending upwardly from the base 52. The protrusions 62 extend radially outward from the center of the screw base 52 (and the longitudinal axis L-L') and spaced apart about 90 degrees from each other. The screw assembly 50 and protrusions 62 are constructed such that each one of the protrusions 62 may engage at least one of the second plurality of shell protrusions 34 of the inner shell 20 when the screw assembly 50 is inserted within the first open end 24 of the inner shell 20. The screw assembly 50 may be partially or fully inserted into the first open end 24 of the inner shell 20 such that the spindle 54 is movably associated with and disposed within the chamber 28. As shown in FIG. 6, for example, each one of the protrusions 62 may be positioned within a first space (e.g., first space 35*a*, FIG. 9) between adjacent protrusions of the second plurality of shell protrusions 34 when the screw assembly 50 is assembled with at least the inner shell 20.

The package 1 may also include an elevator platform 70 movably engaged to the spindle 54 of the screw assembly 50. As shown in FIG. 6, the elevator platform 70 may include an aperture 72 disposed therethrough having internal threads 74. The external threads 58 of the spindle 54 are constructed to threadingly engage the internal threads 74 of the elevator platform 70. The threads 58 may have a variety of pitches constructed to move the elevator platform 70 a certain linear distance per an entire 360 degree rotation of the screw base 52.

As an example, when a rotational force (e.g., illustrated by arrow A or arrow B) is applied to the screw base 52 by a user, the screw assembly 50, including the spindle 54, rotates causing the threads 58 to rotate within the aperture 72 and moving the elevator platform 70 in a linear direction along the longitudinal axis L-L'. Simultaneously, when the screw base 52 rotates, each one of the protrusions 62 moves from the first space 35*a*, engaging (e.g., sliding up and over the protrusions) a respective one of the second plurality of shell protrusions 34 and into a second adjacent space 35*b* on the opposite side of the engaged protrusions 34. When the screw assembly 50 is rotated, the elevator platform 70 is displaced a linear length along the longitudinal axis L-L' due to the pitch of the threads 58. The engagement and movement of the protrusions 62 over the second plurality of shell protrusions 34 does not displace the elevator platform 70 such as for example, a distance equal to the protrusions (h). Such engagement and movement of the protrusions displaces the screw base 52, not the elevator platform 70.

The movement and/or engagement of the protrusions 62 with the respective protrusions of the second plurality of shell protrusions 34 from the first space 35*a* to the subsequent positioning into the second space 35*b* may create an audio queue or signal such as, for example, a "click." It should be understood that the user may continue to rotate and cause the protrusions 62 to engage one or more protrusions of the second plurality of shell protrusions 34 and adjacent spaces 35*n* until a desired dose is achieved. Additionally, such movement and/or engagement may provide a resistance to the rotation that they user may feel, providing a tactile queue as well. Such queues may identify to the user that a dose of the product has been dispensed. Instructions may be provided to the user, in some aspects, identifying how many "clicks" and/or rotations into adjacent spaces are required for a normal product dose. By controlling parameters such as, for example, the shape, size (e.g., height), spacing, and/or frequency of protrusions 34, the user's dosing experience and control is impacted. The protrusions 62 and the second plurality of shell protrusions 34 are constructed to not provide pressure relief to the product contained within the chamber 28. However, it is understood that one or more of the protrusions 62 and/or 34 may be constructed to provide pressure relief to the product.

Figure 17:
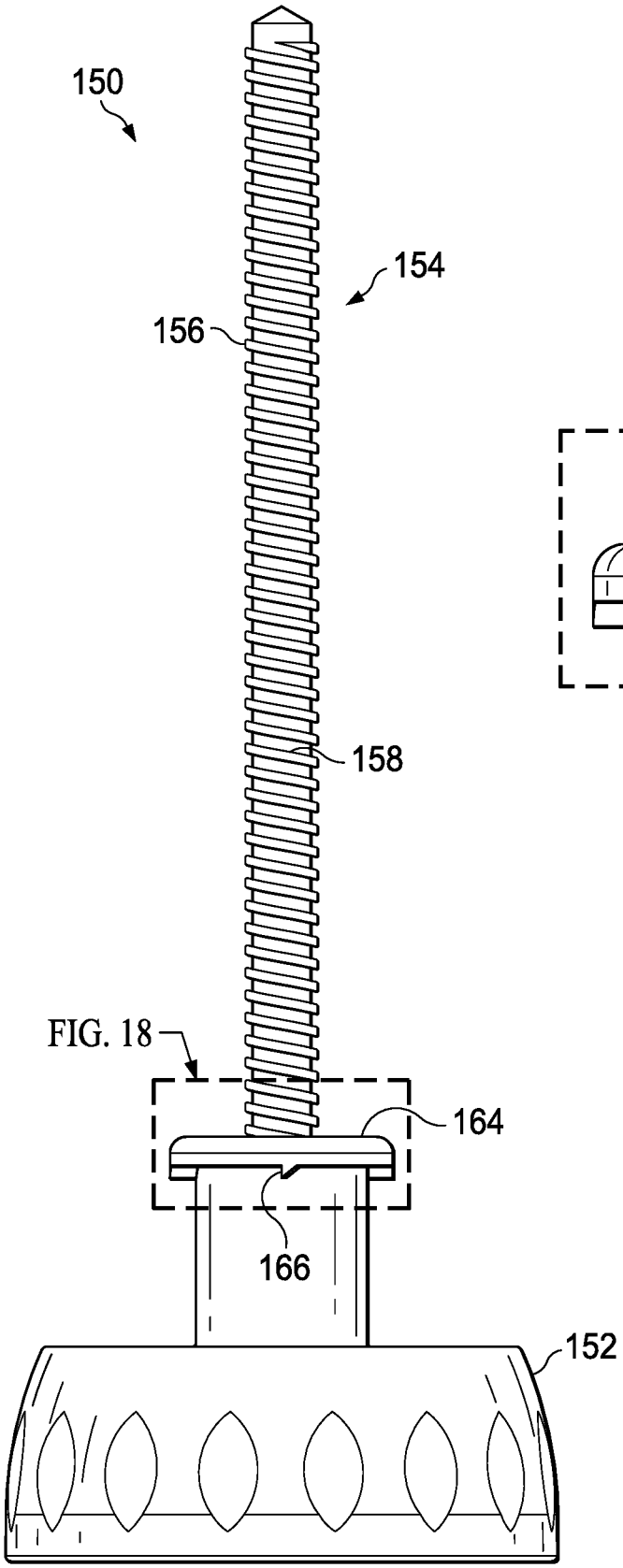
FIG. 17 is a side elevational view of a spindle assembly of the dispensing package of FIG. 1.
Figure 18:
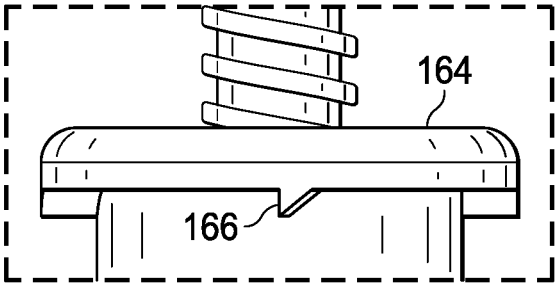
FIG. 18 is a detail of the spindle assembly of FIG. 17.

Referring to FIGS. 17 and 18, in one or more of the aspects of the dispensing package 1 described and shown herein, the screw assembly 50 may be replaced with a screw assembly 150. In some aspects, the dispensing package 1 may include the screw assembly 150. The screw assembly 150 may be partially or fully inserted into the first open end 24 of the inner shell 20. The screw assembly 150 may include a screw base 152, a spindle 154 extending from the screw base 152 and having an outer surface 156, and threads 158 disposed along the outer surface 156 about at least a portion of the spindle 154.

The screw base 152 may include one or more protrusions extending upwardly from the screw base. In the aspect shown in the figures, the screw base 152 may include a top surface 160 and protrusions 62, for example, four protrusions, extending upwardly from the base 152. The protrusions 62 extend radially outward from the center of the screw base 152 (and the longitudinal axis L-L') and may be spaced apart about 90 degrees from each other. The screw assembly 150 and protrusions 62 are constructed such that each one of the protrusions 62 may engage at least one of the second plurality of shell protrusions 34 of the inner shell 20 when the screw assembly 150 is inserted within the first open end 24 of the inner shell 20. The screw assembly 150 may be partially or fully inserted into the first open end 24 of the inner shell 20 such that the spindle 154 is movably associated with and disposed within the chamber 28.

As set forth above, the package 1 may also include an elevator platform 70 movably engaged to the spindle 154 of the screw assembly 150. As shown in FIG. 6, the elevator platform 70 may include an aperture 72 disposed therethrough having internal threads 74. The external threads 158 of the spindle 154 are constructed to threadingly engage the internal threads 74 of the elevator platform 70. The threads 158 may have a variety of pitches constructed to move the elevator platform 70 a certain linear distance per an entire 360 degree rotation of the screw base 152.

The screw assembly 150 may also include a platform 164 spaced apart from the screw base 152 along the longitudinal axis L-L' and extending substantially radially from the spindle 154. The platform 164 may include a one or more spindle protrusions 166 extending downwardly from and disposed about the platform. In some aspects, the one or more spindle protrusions 166 are constructed to engage the first plurality of shell protrusions 32. In some aspects, the spindle protrusion(s) 166 are constructed to have a reciprocal shape to the shape of the first plurality of shell protrusions 32. In the aspects shown in FIGS. 1-18, the first plurality of shell protrusions comprise a tooth-shape with a cam surface 36. Correspondingly, the one or more spindle protrusions 166 may comprise a reciprocal tooth shape as shown in FIGS. 17 and 18 that includes a cam surface 168 such that the cam surface 168 of the one or more spindle protrusions 166 engages (e.g., slides along, up and over) the cam surface(s) 36 of one or more protrusions of the first plurality of shell protrusions 32. The one or more protrusions 166 and the first plurality of shell protrusions 32 are constructed to provide pressure relief to the product contained within the chamber 28 (i.e., mitigate or eliminate weeping). In this aspect, the first plurality of shell protrusions 32 and the spindle protrusion(s) 166 are constructed to displace the elevator platform 70 a linear distance equal to at least a portion of the pitch of the threads 158 plus the height (H) of the protrusions as well understood in the prior art. However, it is understood that one or more of the protrusions 166 and/or 32 may be constructed to not provide pressure relief to the product.

EXAMPLES

1. A dispensing package 1, the dispensing package comprising:
   - a longitudinal axis;
   - a shell 20 comprising
     - a chamber 28 disposed within the shell 20, preferably the chamber contains an antiperspirant and deodorant composition,
     - a first end 24,
     - a second end 26 opposite the first end 24,
       - a first plurality of shell protrusions 32 extending upwardly away from the first end 24, and
     - a second plurality of shell protrusions 34 extending downwardly in a direction opposite the first plurality of shell protrusions 32;
   - a screw assembly 50, 150 comprising
     - a screw base 52, 152 disposed adjacent to the first end 24 and rotatably associated with the shell 20,
     - a spindle 54, 154 extending coaxially to the longitudinal axis from the screw base 52, 152; and
   - an elevator platform 70 movably engaged to the spindle 54,154 of the screw assembly 50, 150, preferably the first plurality of shell protrusions 32 differs from the second plurality of shell protrusions 34 in one or more of the following: frequency of protrusions, spacing, shape, height, length, or angle of contact face, more preferably the first plurality of shell protrusions 32 has a lower frequency of protrusions than the second plurality of shell protrusions 34.

2. The dispensing package according to example 1, wherein the first plurality of shell protrusions 32 is constructed to dispense a dose of product that is different in volume, preferably larger in volume, than the second plurality of shell protrusions 34.

3. The dispensing package according to any one of the examples 1-2, wherein the shell 20 further comprises a bottom wall 23 disposed at the first end 24 such that the first plurality of shell protrusions 32 extend from the bottom wall 23 and the second plurality of shell protrusions 34 extend from the bottom wall 23 in a direction opposite the first plurality of shell protrusions 32, preferably the shell 20 further comprises a opening 24 disposed within the bottom wall 23 for bottom filling, more preferably the bottom wall 23 is a plug 25 that is constructed to insert into and connect to an open end disposed at the first end 24 of the shell 20 after filling the chamber 28 with product.

4. The dispensing package according to any one of the examples 1-3, wherein the screw base 52, 152 further comprises a screw base protrusion 62, extending upwardly from the screw base 52, 152 and constructed to engage at least one of the second plurality of shell protrusions 34, preferably the screw base protrusion 62, comprises a plurality of screw base protrusions, and wherein each one of the plurality of screw base protrusions is constructed to engage at least one of the second plurality of shell protrusions 34, more preferably the plurality of screw base protrusions 62, comprises four screw base protrusions disposed 90 degrees from each other about the longitudinal axis.

5. The dispensing package according to any one of the examples 1-4, wherein the spindle 54, 154 further comprises a spindle protrusion 166 extending downwardly and constructed to engage at least one of the first plurality of shell protrusions 32.

6. The dispensing package according to any one of the examples 1-4, wherein the screw assembly 50, 150 further comprises a platform 64, 164 spaced apart from the screw base 52, 152 along the longitudinal axis and extending radially away from the spindle 54, 154 and a spindle protrusion 166 extending downwardly from the platform 164, the spindle protrusion constructed to engage at least one of the first plurality of shell protrusions 32.

7. The dispensing package according to example 5 or 6, wherein the spindle protrusion 166 comprises a plurality of spindle protrusions, and wherein each one of the plurality of spindle protrusions is constructed to engage at least one of the first plurality of shell protrusions 32, preferably the plurality of spindle protrusions 166 comprises four spindle protrusions disposed 90 degrees from each other about the longitudinal axis.

8. The dispensing package according to any one of the examples 1-7, wherein the spindle 54, 154 comprises threads 58, 158 disposed along an exterior surface 56, 156, and wherein the elevator platform 70 is threadingly engaged to the spindle 54, 154.

9. The dispensing package according to any one of the examples 1-8, wherein the first plurality of shell protrusions 32 comprises from 1 to 60 protrusions, preferably the second plurality of shell protrusions 34 comprises from 1 to 60 protrusions, more preferably the first plurality of shell protrusions 32 comprises from 10 to 30 protrusions and the second plurality of shell protrusions 34 comprises from 20 to 60 protrusions.

10. The dispensing package according to any one of the examples 1-9, wherein the second plurality of shell protrusions 34 has a lower frequency of protrusions than the first plurality of shell protrusions 32.

11. The dispensing package according to any one of the examples 1-10, wherein the first plurality of shell protrusions 32 or second plurality of shell protrusions 34 of the shell 20 are selected from the following group of protrusions: teeth, pawls, ratchet, cams, ramps, and combinations thereof.

12. The dispensing package according to any one of the examples 1-11, wherein the first plurality of shell protrusions 32 are shell teeth including a cam surface 36 having a lead angle $\alpha$ from 10 degrees to 75 degrees and a height (h) from 0.010 in. to 0.10 in.

13. The dispensing package according to example 7, wherein each one of the plurality of spindle protrusions 166 are spindle teeth that include a cam surface 168 having a lead angle $\alpha$ from 10 degrees to 75 degrees and a height (h) from 0.010 in. to 0.10 in., and wherein each one of the cam surfaces 168 of the plurality of spindle teeth is constructed to engage a cam surface 36 of the first plurality of shell teeth 32.

14. The dispensing package according to any one of the examples 1-13, wherein the second plurality of shell protrusions 34 are shell teeth including a cam surface 36 having a lead angle $\alpha$ from 10 degrees to 75 degrees and a height (h) from 0.005 in. to 0.050 in.

15. The dispensing package according to example 4, wherein each one of the plurality of screw base protrusions 62, are screw base teeth that include a cam surface 36 having a lead angle $\alpha$ from 10 degrees to 75 degrees and a height (h) from 0.005 in. to 0.095 in., and wherein each one of the cam surfaces 36 of the plurality of screw base teeth is constructed to engage a cam surface of the second plurality of shell teeth.

16. The dispensing package according to any one of the examples 1-15, further comprising an outer shell 10 disposed at least partially over the shell 20, preferably further comprising an antiperspirant and deodorant composition disposed in the chamber 28 of the shell 20, and an outer shell 10 having a chamber 18 disposed therein such that the shell 20 is disposed as least partially within the chamber 18 of the outer shell 10.

In some embodiments, the dispensing packages described in Examples 1-15 may comprise a screw base protrusion comprising a plurality of screw base protrusions, wherein each one of the plurality of screw base protrusions is constructed to engage at least one of the second plurality of shell protrusions, and wherein the second plurality of shell protrusions are shell teeth including a cam surface having a lead angle $\alpha$ from about 10 degrees to about 75 degrees and a height (h) from about 0.005 in. to about 0.050 in. In some such embodiments, each one of the plurality of screw base teeth may include a cam surface having a lead angle $\alpha$ from about 10 degrees to about 75 degrees and a height (h) from about 0.005 in. to about 0.095 in., and each one of the cam surfaces of the plurality of screw base teeth is constructed to engage a cam surface of the second plurality of shell teeth.

In another example, a screw assembly for a consumer product dispensing package, the screw assembly comprises:

a longitudinal axis;

a screw base including a plurality of screw base protrusions extending upwardly from the screw base; preferably wherein the plurality of screw base protrusions comprises from about 1 to about 60 protrusions;

a spindle extending from the screw base coaxial to the longitudinal axis, the spindle including an outer surface and threads disposed about the outer surface; and a platform extending radially from the spindle and spaced apart from the screw base, the platform including a plurality of spindle protrusions extending downwardly from the platform;

preferably wherein the plurality of spindle protrusions comprises from about 1 to about 60 protrusions;

preferably wherein the plurality of screw base protrusions differs from the plurality of spindle protrusions in one or more of the following: frequency of protrusions, spacing, shape, height, length, or angle of contact face;

preferably wherein the plurality of screw base protrusions is constructed to dispense a dose of product that is different in volume than the plurality of spindle protrusions.

In another example, a dispensing package, the dispensing package comprises:

a longitudinal axis;

a shell comprising a chamber disposed therein and constructed to contain a consumer product, a first end, and a second end opposite the first end; and a screw assembly comprising a screw base disposed adjacent to the first end and rotatably associated with the shell, the screw base including a plurality of screw base protrusions extending upwardly from the screw base, a spindle extending from the screw base through the bottom wall into the chamber coaxial to the longitudinal axis of the package, the spindle including an outer surface and threads disposed about the outer surface, and a platform extending radially from the spindle and spaced apart from the screw base, the platform including a plurality of spindle protrusions extending downwardly from the platform;

wherein preferably the plurality of screw base protrusions differs from the plurality of spindle protrusions in one or more of the following: frequency of protrusions, spacing, shape, height, length, or angle of contact face;

wherein preferably the shell further comprises a shell protrusion extending from the first end of the shell and constructed to engage the plurality of screw base protrusions or the plurality of spindle protrusions; more preferably the shell protrusion comprises four shell protrusions disposed about 90 degrees apart about the longitudinal axis, each of the four shell protrusions constructed to engage the plurality of screw base protrusions or the plurality of spindle protrusions, yet more preferably each one of the four shell protrusions engage a corresponding one of the plurality of screw base protrusions or the plurality of spindle protrusions.

In some embodiments, a dispensing package, such as any described above, may have the shell protrusion comprise four shell protrusions disposed about 90 degrees apart about the longitudinal axis, wherein each of the four shell protrusions are constructed to engage the plurality of screw base protrusions or the plurality of spindle protrusions. In some embodiments, each one of the four shell protrusions engage a corresponding one of the plurality of screw base protrusions or the plurality of spindle protrusions.

In some aspects, a kit may be provided with the dispensing package 1 including one or more features described and shown above such as, for example, an outer shell, inner shell with both the first plurality of shell protrusions 32 and second plurality of shell protrusions 34, screw assembly 50 having the one or more protrusions 62 and screw assembly 150 having the one or more protrusions 166.

It should be understood that any feature and/or element of any one of the aspects and/or examples shown and described above herein may be removed from the aspect and/or example, replaced with a feature or element from another aspect or example herein or replaced with an equivalent feature or element.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing package, the dispensing package comprising:

a longitudinal axis;

a shell comprising a chamber disposed within the shell, a first end, a second end opposite the first end, a first plurality of shell protrusions extending upwardly away from the first end, and a second plurality of shell protrusions extending downwardly in a direction opposite the first plurality of shell protrusions;

a screw assembly comprising a screw base disposed adjacent to the first end and rotatably associated with the shell, a spindle extending from the screw base through a bottom wall into the chamber coaxial to the longitudinal axis of the package; and an elevator platform movably engaged to the spindle of the screw assembly; and wherein the first plurality of shell protrusions differs from the second plurality of shell protrusions in one or more of the following: frequency of protrusions, spacing, shape, height, length, or angle of contact face; and wherein the spindle further comprises a spindle protrusion extending downwardly and constructed to engage at least one of the first plurality of shell protrusions.

2. The dispensing package of claim 1, wherein the first plurality of shell protrusions is constructed to dispense a dose of product that is different in volume than the second plurality of shell protrusions.

3. The dispensing package of claim 2, wherein the first plurality of shell protrusions is constructed to dispense a dose of product that is larger in volume than the second plurality of shell protrusions.

4. The dispensing package of claim 1, wherein the shell further comprises a bottom wall disposed at the first end such that the first plurality of shell protrusions extend from the bottom wall and the second plurality of shell protrusions extend from the bottom wall in a direction opposite the first plurality of shell protrusions.

5. The dispensing package of claim 4, wherein the shell further comprises a bottom opening disposed within the bottom wall for bottom filling.

6. The dispensing package of claim 4, wherein the bottom wall is a plug that is constructed to insert into and connect to an open end disposed at the first end of the shell after filling the chamber with product.

7. The dispensing package of claim 1, wherein the screw base further comprises a screw base protrusion extending upwardly from the screw base and constructed to engage at least one of the second plurality of shell protrusions.

8. The dispensing package of claim 7, wherein the screw base protrusion comprises a plurality of screw base protrusions, and wherein each one of the plurality of screw base protrusions is constructed to engage at least one of the second plurality of shell protrusions.

9. The dispensing package of claim 8, wherein the plurality of screw base protrusions comprises four screw base protrusions disposed about 90 degrees from each other about the longitudinal axis.

10. The dispensing package of claim 1, wherein the screw assembly further comprises a platform spaced apart from the screw base along the longitudinal axis and extending radially away from the spindle and a spindle protrusion extending downwardly from the platform, the spindle protrusion constructed to engage at least one of the first plurality of shell protrusions.

11. The dispensing package of claim 1, wherein the spindle protrusion comprises a plurality of spindle protrusions, and wherein each one of the plurality of spindle protrusions is constructed to engage at least one of the first plurality of shell protrusions.

12. The dispensing package of claim 11, wherein the plurality of spindle protrusions comprises four spindle protrusions disposed about 90 degrees from each other about the longitudinal axis.

13. The dispensing package of claim 1, wherein the spindle comprises threads disposed along an exterior surface, and wherein the elevator platform is threadingly engaged to the spindle.

14. The dispensing package of claim 1, wherein the first plurality of shell protrusions has a lower frequency of protrusions than the second plurality of shell protrusions.

15. The dispensing package of claim 14, wherein the first plurality of shell protrusions comprises from about 1 to about 60 protrusions.

16. The dispensing package of claim 14, wherein the second plurality of shell protrusions comprises from about 1 to about 60 protrusions.

17. The dispensing package of claim 14, wherein the first plurality of shell protrusions comprises from about 10 to about 30 protrusions and the second plurality of shell protrusions comprises from about 20 to about 60 protrusions.

18. The dispensing package of claim 1, wherein the second plurality of shell protrusions has a lower frequency of protrusions than the first plurality of shell protrusions.

19. The dispensing package of claim 1, wherein the first plurality of shell protrusions or second plurality of shell protrusions of the shell are selected from the following group of protrusions: teeth, pawls, ratchet, cams, ramps, and combinations thereof.

20. The dispensing package of claim 11, wherein the first plurality of shell protrusions are shell teeth including a cam surface having a lead angle $\alpha$ from about 10 degrees to about 75 degrees and a height (h) from about 0.010 in. to about 0.10 in.

21. The dispensing package of claim 20, wherein each one of the plurality of spindle protrusions are spindle teeth that include a cam surface having a lead angle $\alpha$ from about 10 degrees to about 75 degrees and a height (h) from about 0.010 in. to about 0.10 in., and wherein each one of the cam surfaces of the plurality of spindle teeth is constructed to engage a cam surface of the first plurality of shell teeth.

22. The dispensing package of claim 8, wherein the second plurality of shell protrusions are shell teeth including a cam surface having a lead angle $\alpha$ from about 10 degrees to about 75 degrees and a height (h) from about 0.005 in. to about 0.050 in.

23. The dispensing package of claim 22, wherein each one of the plurality of screw base teeth includes a cam surface having a lead angle $\alpha$ from about 10 degrees to about 75 degrees and a height (h) from about 0.005 in. to about 0.095 in., and wherein each one of the cam surfaces of the plurality of screw base teeth is constructed to engage a cam surface of the second plurality of shell teeth.

24. The dispensing package of claim 2, wherein first plurality of shell protrusions and second plurality of shell protrusions are non-removably associated with the shell.

25. The dispensing package of claim 2, wherein the screw assembly is removably attached to the shell.

26. The dispensing package of claim 2, further comprising an outer shell disposed at least partially over the shell.

27. The dispensing package of claim 26, wherein the chamber of the shell contains an antiperspirant and deodorant composition.

28. The dispensing package of claim 2, further comprising an antiperspirant and deodorant composition disposed in the chamber of the shell, and an outer shell having a chamber disposed therein such that the shell is disposed as least partially within the chamber of the outer shell.

29. A dispensing package, the dispensing package comprising:

- a longitudinal axis;
- a shell comprising
  - a chamber disposed therein and constructed to contain a consumer product,
  - a first end, and
  - a second end opposite the first end; and
- a screw assembly comprising
  - a screw base disposed adjacent to the first end and rotatably associated with the shell, the screw base including a plurality of screw base protrusions extending upwardly from the screw base,
  - a spindle extending from the screw base through a bottom wall into the chamber coaxial to the longitudinal axis of the package, the spindle including an outer surface and threads disposed about the outer surface, and a platform extending radially from the spindle and spaced apart from the screw base, the platform including a plurality of spindle protrusions extending downwardly from the platform; and wherein the plurality of spindle protrusions comprises four spindle protrusions disposed about 90 degrees from each other about the longitudinal axis;

wherein the plurality of screw base protrusions differs from the plurality of spindle protrusions in one or more of the following: frequency of protrusions, spacing, shape, height, length, or angle of contact face; and wherein the shell further comprises a shell protrusion extending from the first end of the shell and constructed to engage the plurality of screw base protrusions or the plurality of spindle protrusions.

30. The dispensing package of claim 29, wherein the shell protrusion comprises four shell protrusions disposed about 90 degrees apart about the longitudinal axis, each of the four shell protrusions constructed to engage the plurality of screw base protrusions or the plurality of spindle protrusions.

31. The dispensing package of claim 30, wherein each one of the four shell protrusions engage a corresponding one of the plurality of screw base protrusions or the plurality of spindle protrusions.

* * * * *